US006380851B1

(12) United States Patent
Gilbert et al.

(10) Patent No.: US 6,380,851 B1
(45) Date of Patent: Apr. 30, 2002

(54) PROCESSING AND PRESENTING INFORMATION RECEIVED FROM A PLURALITY OF REMOTE SENSORS

(75) Inventors: Bradley L. Gilbert, Burlingame; Therese M. Cleary, Woodside, both of CA (US)

(73) Assignee: Schlumberger Resource Management Services, Inc., Norcross, GA (US)

( * ) Notice: Subject to any disclaimer, the term of this patent is extended or adjusted under 35 U.S.C. 154(b) by 0 days.

(21) Appl. No.: 09/310,457

(22) Filed: May 12, 1999

(51) Int. Cl.[7] ..... G08B 23/00

(52) U.S. Cl. ..... 340/517; 340/506; 340/825.06; 340/825.36; 340/825.49; 340/524

(58) Field of Search ..... 340/506, 508, 340/517, 524, 525, 825.06, 825.36, 825.49

(56) References Cited

U.S. PATENT DOCUMENTS

| | | | | |
|---|---|---|---|---|
| 4,337,466 A | | 6/1982 | Spahn | 340/870.09 |
| 4,356,903 A | | 11/1982 | Lemelson et al. | 194/1 R |
| 5,086,292 A | | 2/1992 | Johnson et al. | 340/637 |
| 5,139,128 A | | 8/1992 | Carmen et al. | 194/343 |
| 5,222,076 A | | 6/1993 | Ng et al. | 375/9 |
| 5,244,070 A | | 9/1993 | Carmen et al. | 194/319 |
| 5,273,151 A | | 12/1993 | Carmen et al. | 194/319 |
| 5,402,475 A | | 3/1995 | Lesner et al. | 379/106 |
| 5,442,348 A | | 8/1995 | Mushell | 340/932.2 |
| 5,553,094 A | | 9/1996 | Johnson et al. | 375/200 |
| 5,563,491 A | | 10/1996 | Tseng | 320/2 |
| 5,614,892 A | | 3/1997 | Ward et al. | 340/870.02 |
| 5,710,743 A | | 1/1998 | Dee et al. | 368/90 |
| 5,740,050 A | | 4/1998 | Ward | 364/464.28 |
| 5,852,411 A | | 12/1998 | Jacobs et al. | 340/932.2 |
| 5,903,520 A | | 5/1999 | Dee et al. | 368/90 |
| 5,910,782 A | * | 6/1999 | Schmitt et al. | 340/995 |

FOREIGN PATENT DOCUMENTS

| | | |
|---|---|---|
| WO | WO 97/29466 | 8/1997 |

* cited by examiner

*Primary Examiner*—Daryl Pope
(74) *Attorney, Agent, or Firm*—Fish & Richardson P.C.

(57) ABSTRACT

The application discloses a processing system that includes a processor configured to qualify, based at least in part upon meta information, environmental status information extracted from signals received from a plurality of remote sensors, each of the sensor signals being indicative of the condition of a respective environment being monitored by a corresponding one of the sensors. The processor preferably is configured to generate a report of the status of a plurality of physically distributed environments based at least in part upon correlation of environmental status information extracted from a plurality sensor signals indicative of the condition of a plurality of respective monitored environments with information relating to the activities of one or more entities authorized to interact with the monitored environments. Methods of processing information received from a plurality of remote sensors also are disclosed.

35 Claims, 4 Drawing Sheets

PROCESSING AND PRESENTING INFORMATION RECEIVED FROM A PLURALITY OF REMOTE SENSORS

BACKGROUND OF THE INVENTION

The invention relates to apparatus and methods of processing and presenting information received from a plurality of remote sensors.

The operation, maintenance, management and security of a system of physically distributed endpoints (e.g., parking meters, vending machines, photocopiers, traffic lights and other distributed devices) often may require the allocation of significant monitoring efforts and the deployment of significant resources. In an effort to reduce the monitoring and resource demands associated with operating, maintaining, managing and securing multiple physically distributed endpoints, sensors which are configured to monitor the status of each endpoint have been proposed. For example, in the case of parking meters, sensors which are configured to wirelessly transmit status information, such as the occurrence of a meter malfunction and the opening of a meter vault without an authorized key, have been proposed in U.S. Pat. No. 4,356,903. Further improvements in the collection, processing, distribution and presentation of information received from such remote and physically distributed sensors are possible.

SUMMARY OF THE INVENTION

In one aspect, the invention features a processing system that includes a processor configured to qualify, based at least in part upon meta information, environmental status information extracted from signals received from a plurality of remote sensors, each of the sensor signals being indicative of the condition of a respective environment being monitored by a corresponding one of the sensors.

In another aspect, the invention features a processing system that includes the above-identified processor, a plurality of remote sensors each configured to monitor one or more parameters representative of the condition of a respective environment and to transmit signals representative of the one or more monitored parameters, and at least one collector configured to extract environmental status information from signals received from one or more of the plurality of sensors.

Another aspect of the invention features a processor configured to generate a report of the status of a plurality of physically distributed environments based at least in part upon correlation of environmental status information extracted from a plurality sensor signals indicative of the condition of a plurality of respective monitored environments with information relating to the activities of one or more entities authorized to interact with the monitored environments.

Embodiments may include one or more of the following features.

Each of the sensors preferably has a wireless transmitter for transmitting signals representative of the one or more monitored parameters. The processor preferably is configured to receive from a user meta information for qualifying the environmental status information. The processor may be configured to receive meta information in the form of a schedule of planned visits to each of the monitored environments. The processor may be configured to receive in real time meta information from a user in the form of a schedule of one or more planned visits to one or more of the monitored environments. The may be configured to qualify sensor signals representative of an alarm condition based upon the received meta information. The processor also may be configured to qualify sensor signals representative of an alert condition based upon the received meta information.

The processor preferably is configured to present the qualified environmental status information on a display. The processor may be configured to present on the display a form prompting a user to enter meta information for qualifying the environmental status information.

Each of the sensors preferably is configured to monitor the physical condition of a respective parking meter. Each of the sensors may be configured to monitor opening and closing of the parking meter. Each of the sensors may be configured to monitor the physical condition of a respective vending machine or an article of office equipment. Each of the sensors may be configured to monitor the physical condition of a respective residential home.

The environmental status information may correspond to the amount of funds contained in a plurality of remote, physically distributed parking meter systems, and the processor may be configured to qualify the environmental status information to provide an indication when the parking meter systems should be scheduled for collection.

In another aspect, the invention features a processing method, comprising: based at least in part upon meta information, qualifying environmental status information extracted from signals received from a plurality of remote sensors, each of the sensor signals being indicative of the condition of a respective environment being monitored by a corresponding one of the sensors.

Environmental status information may be extracted from signals received from one or more sensors. One or more parameters representative of the condition of a respective environment may be monitored and wirelessly transmitting signals representative of the one or more monitored parameters. Meta information for qualifying the environmental status information may be received from a user. The meta information may be received in the form of a schedule of planned visits to each of the monitored environments. The meta information may be received in real time from a user in the form of a schedule of one or more planned visits to one or more of the monitored environments.

Sensor signals representative of an alarm condition may be qualified based upon the received meta information. Sensor signals representative of an alert condition may be qualified based upon the received meta information.

The qualified environmental status information may be presented on a display. A form prompting a user to enter meta information for qualifying the environmental status information may be presented on the display.

Another aspect of the invention features a processing method, comprising: with a plurality of sensors monitoring one or more parameters indicative of the condition of a plurality of respective environments, each being monitored by a corresponding one of the sensors; wirelessly transmitting signals representative of the one or more monitored parameters; receiving the transmitted signals; extracting environmental status information from the received signals; and qualifying the extracted environmental status information based at least in part upon meta information received from a user.

In another aspect, the invention features a processing method, comprising: receiving environmental status information extracted from a plurality sensor signals indicative of the condition of a plurality of respective, physically distributed environments; receiving information relating to the activities of one or more entities authorized to interact with the monitored environments; correlating the environmental status information with the authorized interaction information; and generating a report of the status of the plurality of physically distributed environments based at least in part upon the results of the correlation.

The report may be presented to a supervising entity.

Among the advantages of the invention are the following. The invention enables end users to optimize the management, collection, maintenance and security monitoring of a plurality of physically distributed end points (e.g., parking meters, vending machines, and other distributed devices). The invention provides implicit communication channels among a variety of separate and distinct entities that may be assigned one or more tasks involving interaction with such endpoints. These implicit communication channels are implemented in an efficient, cost effective and centralized way and enable various authorized and supervising entities to efficiently carry out their assigned tasks. For example, the invention enables a supervising entity (e.g., a police department) to easily distinguish an entity interacting with an endpoint with authorization from an entity interacting with the endpoint without authorization. This feature of the invention is enabled without requiring each endpoint to include a system (e.g., a password or other verification system) for distinguishing authorized users from unauthorized users.

Other features and advantages will become apparent from the following description, including the drawings and the claims.

DETAILED DESCRIPTION

Figure 1:
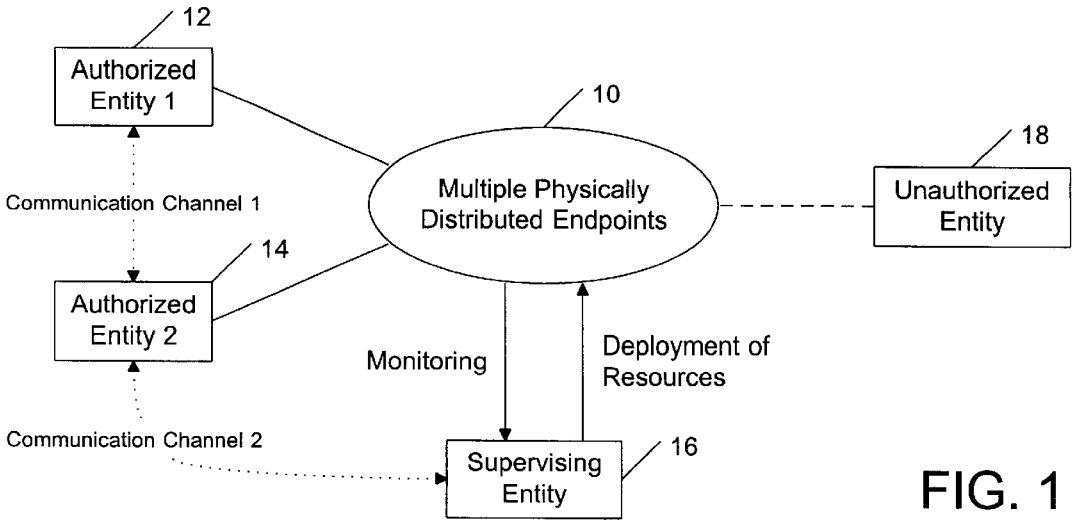
FIG. 1 is a diagrammatic view of two entities which are authorized to interact with multiple physically distributed endpoints, an entity responsible for supervising interactions with the endpoints, and an entity which is not authorized to interact with the endpoints.

Referring to FIG. 1, in one embodiment, multiple endpoints 10 (e.g., parking meters, vending machines, office equipment such as photocopiers, traffic lights and other distributed devices) must be operated, managed, maintained and protected against theft and destruction. The physical distribution of endpoints 10 poses a number of efficiency issues that often may be (or inherently must be) addressed by assigning various interaction tasks to separate entities. The separate entities may be part of the same organization or may be part of separate and distinct organizations. For example, where the endpoints 10 are parking meters, a first entity 12 may be authorized to maintain endpoints 10 and a second entity 14 may be authorized to collect the funds deposited into endpoints 10; each of these tasks involves various interactions between the agents of authorized entities 12 and 14 and multiple endpoints 10. A supervising entity 16 (e.g., the police department or a private security firm) may be responsible for the security of multiple endpoints 10. In carrying out this responsibility, supervising entity 16 must monitor interactions with endpoints 10 and must deploy resources when unauthorized interactions (e.g., theft or vandalism) have been observed. Unless special measures are taken, however, the interactions of authorized entities 12 and 14 (e.g., opening the vault portion of a parking meter in order to maintain the meters or to collect funds from the meters) are difficult or impossible to distinguish from the interaction of an unauthorized entity 18 (e.g., breaking into a parking meter vault in order to steal funds). Such special measures might include posting one or more security guards to visually monitor endpoints 10, or requiring authorized entities 12, 14 to enter an access code or other verification information to prevent an alarm from being sent to supervising entity 16 upon interaction with one of the endpoints 10. These measures, however, may be costly and may lead to an inefficient allocation of resources.

As explained in detail, below, one aspect of the invention enables entities assigned with the task of interacting with physically distributed endpoints 10 to efficiently utilize their resources in carrying out these tasks, at least in part, by providing implicit communication channels between authorized entities 12 and 14 and supervising entity 16 that enable supervising entity 16 to distinguish easily authorized interactions with endpoints 10 from unauthorized interactions with endpoints 10.

Figure 2:
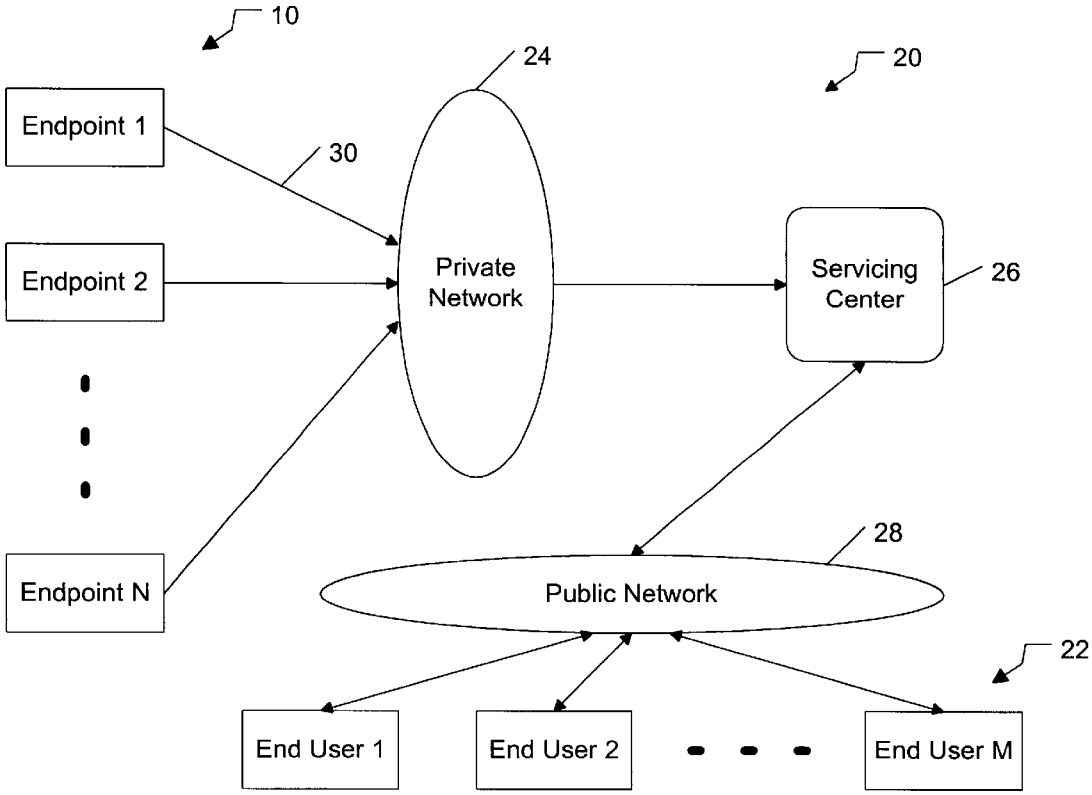
FIG. 2 is a diagrammatic view of a system for collecting and processing information received from a plurality of endpoints and for distributing and presenting that information to a plurality of end users.

Referring to FIG. 2, a system 20 is configured to collect and process information received from a plurality of endpoints 10 (1-N) and to distribute and present that information to a plurality of end users 22 (1-M). System 20 includes a private network 24 (e.g., a wireless network available from CellNet Data Systems, Inc. of San Carlos, Calif.), a servicing center 26, and a public network 28 (e.g., the internet or the public telephone network). In operation, each endpoint 1-N transmits signals 30 indicative of its condition. These signals 30 are transmitted through private network 24 to servicing center 26, where status information relating to the condition of endpoints 10 is extracted from signals 30. Servicing center 26 also receives certain meta information (e.g., information relating to the activities of one or more entities authorized to interact with endpoints 10) from end users 22 over public network 28. Servicing center 26 includes a processor configured to generate one or more reports of the status of the plurality of physically distributed endpoints 10 based at least in part upon correlation of environmental status information extracted from endpoint signals 30 with the received meta information. Servicing center 26 transmits the generated reports to end users 22 over public network 28. As explained in detail below, end users 22 may use these reports to optimize their interactions with end points 10 (e.g., to efficiently allocate resources needed to carry out one or more assigned tasks). The meter information and the report information may be encrypted; alternatively, a password or other verification information may be required in order to transmit information to or receive information from servicing center 26.

Figure 3:
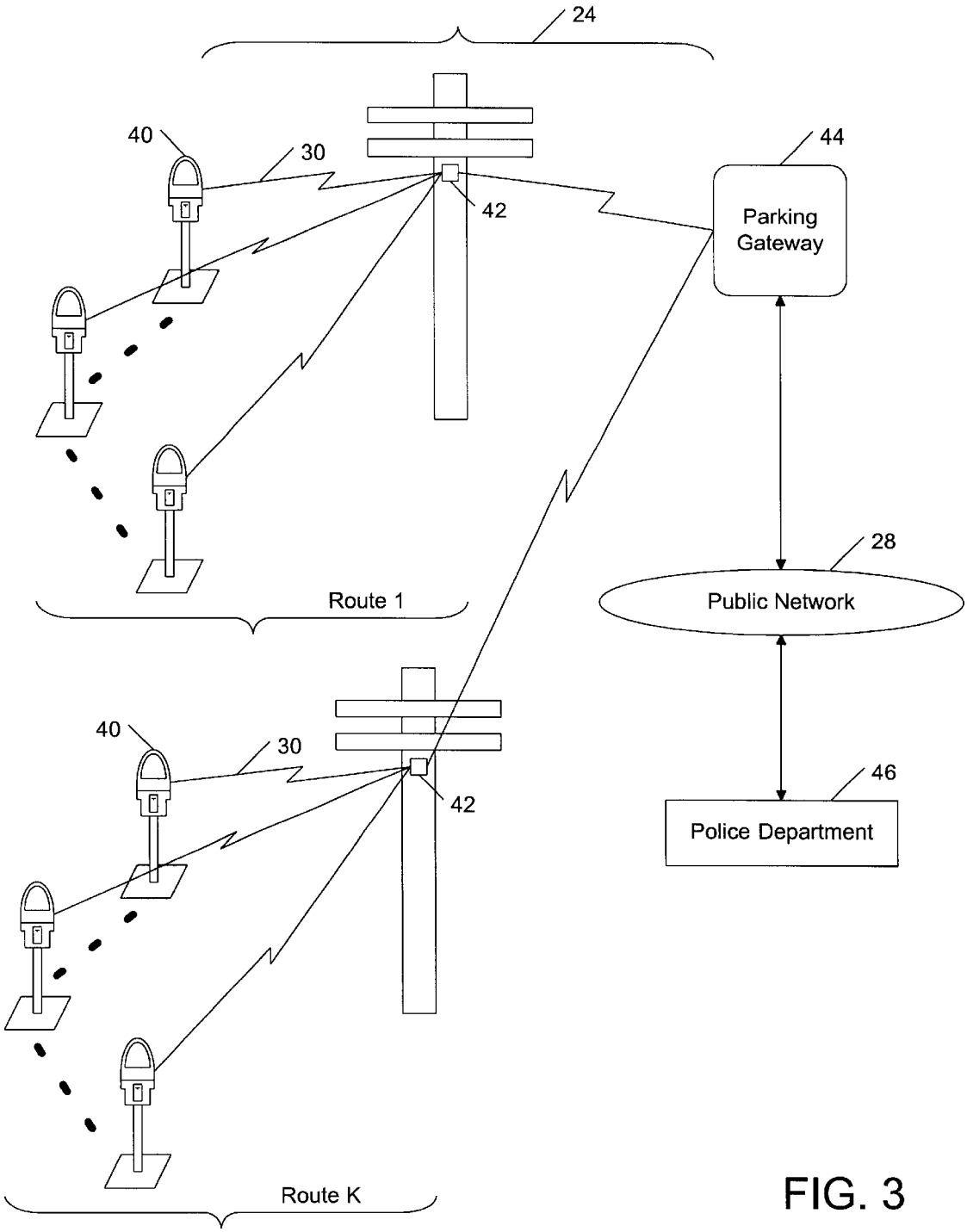
FIG. 3 is a diagrammatic view of a system for collecting, processing and presenting information relating to the condition of a plurality of parking meter systems.

As shown in FIG. 3, in one implementation, endpoints 10 consist of a plurality of parking meter systems 40 that are physically distributed and organized along a plurality of collection/maintenance routes (1-K). Each parking meter system 40 within an assigned route transmits to a corresponding collector 42 a signal 30 indicative of various aspects of the condition of the meter (e.g., the status of the doors providing access to the interior of the meter, diagnostic information about the operational status of various components of the meter, and collection information relating to the amount of finds contained in the meter). In general, one collector 42 is assigned to collect signals 30 transmitted by the parking meter systems of a particular route; although additional collectors may be needed depending upon the geographic area of the route and the strength of parking meter system transmissions. A collector may be mounted to a utility pole (as shown) or may be placed at any other suitable location within the geographic vicinity of the parking meter systems of the assigned route. Each collector includes a processor for extracting meter status information from signals 30, a memory for storing parking meter system transmissions, and a transmitter for transmitting information contained in the received transmissions to a parking gateway 44 (or servicing center). Parking gateway 44 processes the information into a status report and transmits the status report to a police department 46 which is responsible for preventing theft and vandalism of the parking meter systems 40. Parking gateway may receive meta information (e.g., information, such as collection schedule information and maintenance schedule information, that relates to the activities of one or more entities authorized to interact with parking meter systems 40) from police department 46 or from another entity, such as one of the entities authorized to interact with parking meter systems 40.

Details of the construction and operation of collectors 42, as well as details of the form of transmissions 30, are contained in U.S. application Ser. No. 08/597,724, filed Feb. 7, 1996, and entitled "A Metering System," which is incorporated herein by reference.

Figure 4:
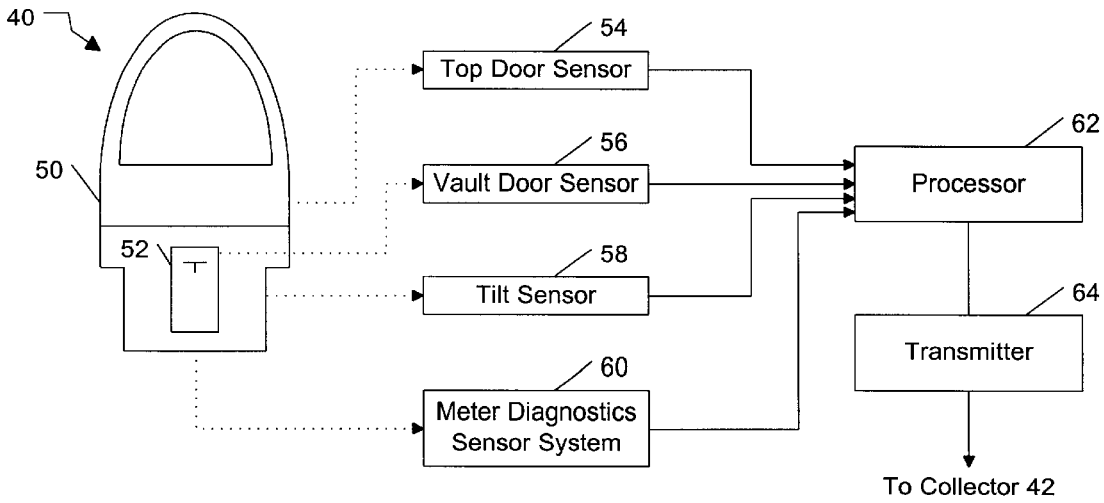
FIG. 4 is a diagrammatic view of a parking meter system, including a plurality of sensors, a processor and a transmitter.

Referring to FIG. 4, in one embodiment, a parking meter system 40 includes a top door 50 which may be opened to access internal components of the meter system, and a vault door 52 which may be opened to access finds (e.g., coins) deposited into the meter system. Parking meter system 40 also includes a top door sensor 54 which monitors the opening and closing of top door 50, a vault door sensor 56 which monitors the opening and closing of vault door 52, and a tilt sensor 58 which monitors the orientation of the meter system relative to a vertical axis. Parking meter system 40 further includes a meter diagnostics sensor system 60 for monitoring various aspects of the operation of the meter system. Signals from sensors 54–60 are transmitted to a processor 62 which processes the information and packages the information for transmission to collector 42 by a transmitter 64.

Figure 5:
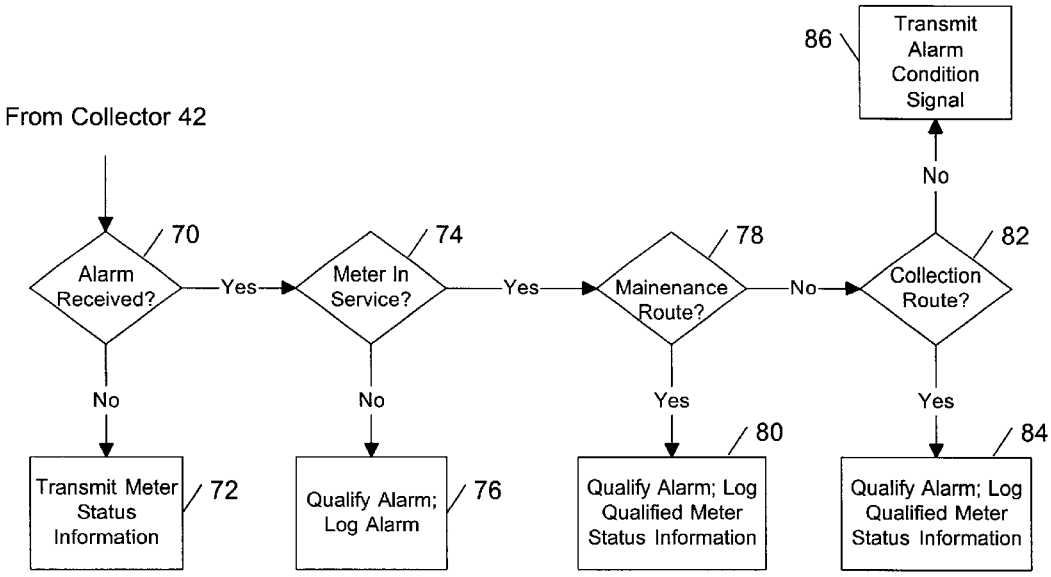
FIG. 5 is a flow diagram of a method of qualifying meter status information extracted from signals received from the parking meter systems of FIG. 3.

Referring to FIG. 5, in one embodiment, parking gateway 44 processes the information received from collectors 42, as follows. Parking gateway 44 determines whether an alarm signal has been received (step 70). If not, the received meter status information is transmitted to police department 46 (step 72). If an alarm signal has been received, parking gateway 44 determines whether the meter system which transmitted the alarm signal is in service (step 74). If the meter is not in service, parking gateway 44 qualifies the alarm by logging the fact that an alarm signal has been received by an out-of-service meter (step 76); parking gateway 44, however, does not transmit an alarm condition indication to the police department 46. The meter service information may be received from police department 46 or from an entity responsible for taking meters into and out of service. If the meter is in service, parking gateway 44 determines whether the meter currently is scheduled for maintenance (step 78). This information may be received from police department 46 or from the entity responsible for maintaining parking meter systems 40. If the meter currently is scheduled for maintenance, parking gateway 44 qualifies the alarm by logging an indication that a maintenance activity has triggered an alarm (step 80); parking gateway 44, however, does not transmit an alarm condition indication to the police department 46. If the meter currently is not scheduled for maintenance, parking gateway 44 determines whether the meter is scheduled for collection (step 82). This information may be received from police department 46 or from the entity responsible for collecting funds from parking meter systems 40. If the meter currently is scheduled for collection, parking gateway 44 qualifies the alarm by logging an indication that a collection activity has triggered an alarm (step 84); parking gateway 44, however, does not transmit an alarm condition indication to the police department 46. If the meter currently is not scheduled for collection, parking gateway 44 transmits an alarm condition signal to police department 46 (step 86).

Among the types of signals transmitted by parking gateway 44 to police department 46 are Alarm signals, Alert signals and Other signals. Alarm signals correspond to sensor signals that usually are triggered by an activity (e.g., theft or vandalism) that would call for immediate action by police department 46. Alert signals correspond to sensor signals that usually are triggered by changes in the operating characteristics of the parking meter system that usually would call for action by maintenance personnel in the near future. Other signals correspond to general operational features of the parking meter system. Examples of such Alarm, Alert and Other signals are presented in Tables 1–3, below. The FLAG indication identifies the qualified meter status information transmitted by parking gateway 44 to police department 46.

TABLE 1

| Alarm Signals | |
|---|---|
| FLAG | DESCRIPTION |
| HA | Housing Open |
| VA | Vault Door Open |
| MA | Meter Tilt |

Alarm signals HA, VA and MA directly correspond to signals sent by top door sensor 54, vault door sensor 56 and tilt sensor 58, respectively.

TABLE 2

| Alert Signals | |
|---|---|
| FLAG | DESCRIPTION |
| HR | Housing Sensor Reset |
| HT | Housing Tamper |
| LB | Low Battery |

TABLE 2-continued

| Alert Signals | |
|---|---|
| FLAG | DESCRIPTION |
| LC | Loss of Communication |
| MR | Meter Tilt Sensor Reset |
| VR | Vault Door Sensor Reset |
| VT | Vault Door Tamper |

Alert signals HR, VR and MR are triggered at parking gateway 44 when the duration of the HA, VA and MA alarm signals exceeds a preselected period of time (e.g., one hour). The HA Alert signal indicates that the top door of a meter has been open for a period that exceeds the time needed for a typical collection or maintenance procedure. The VA Alert signal indicates that the vault door of a meter has been open for a period that exceeds the time needed for a typical collection or maintenance procedure. The MR Alert signal indicates that the tilt sensor 58 has been activated for a period that exceeds a preselected period of time (e.g., the time needed for a typical collection or maintenance procedure). The HT, VT and LB Alert signals correspond to signals generated by meter diagnostics sensor system to indicate, for example, that a transmitter cable has been damaged (HT) or that vault door sensor 56 has been damaged (VT) or that the charging level of the battery supplying power to the meter is low (LB).

The LC Alert signal is triggered at parking gateway 44 when transmissions from a particular meter have not been received for a period exceeding a preselected period of time (e.g., when a transmission has not been received for more than two consecutive scheduled transmission times). In this way, parking gateway 44 qualifies prior transmissions received from a particular meter, by transmitting an Alert signal after a certain number of subsequent, scheduled transmissions have not been received. The prior transmissions are qualified based at least in part upon meta information, including the transmission schedule of the meter and the preselected number of consecutive transmissions that must be missed before the LC Alert signal would be generated.

TABLE 3

| Other Signals | |
|---|---|
| FLAG | DESCRIPTION |
| DC | Post Discovered |
| OS | Out-Of-Service |

The DC Other signal is generated at parking gateway 44 the first time a signal from a parking meter system 40 has been received by parking gateway 44. The OS Other signal is generated at parking gateway 44 in response to an indication by an authorized entity that a particular meter has been taken out-of-service.

After sensor information has been extracted from signals 30 and processed, parking gateway 44 may distribute and present the processed information to one or more entities in a variety of ways.

Figure 6A:
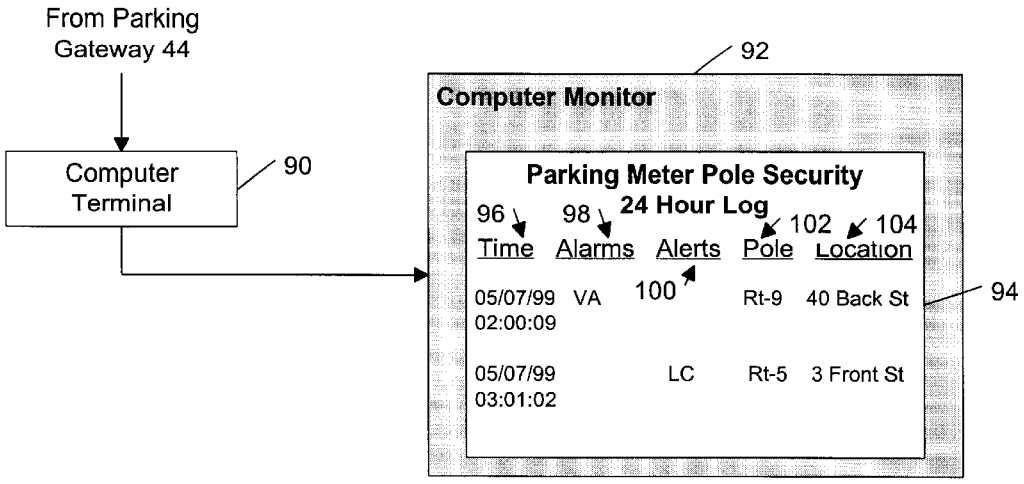
FIG. 6A is a diagrammatic view of a computer terminal and a computer monitor for displaying qualified status information relating to the condition of the plurality of parking meter systems of FIG. 3.

Referring to FIG. 6A, in one embodiment, information transmitted by parking gateway 44 over public network 28 is received at a computer terminal 90 in police department 46. Computer terminal 90 processes the received information and displays the information on a computer monitor 92 in the form of a report 94. Report 94 includes a list of transmission times 96 corresponding to the times at which a signal 30 is transmitted from a particular meter, an indication whether any alarms 98 or alerts 100 were transmitted, and an identification of the pole number 102 and location 104 correspond to the meter which made the transmission. A user (e.g., a police officer or dispatcher) may interaction with parking gateway 44 over public network 28 in order to configure the report in a desired way. For example, a report showing only alarm transmissions or only alert transmissions may be generated by parking gateway 44 and displayed on monitor 92.

Figure 6B:
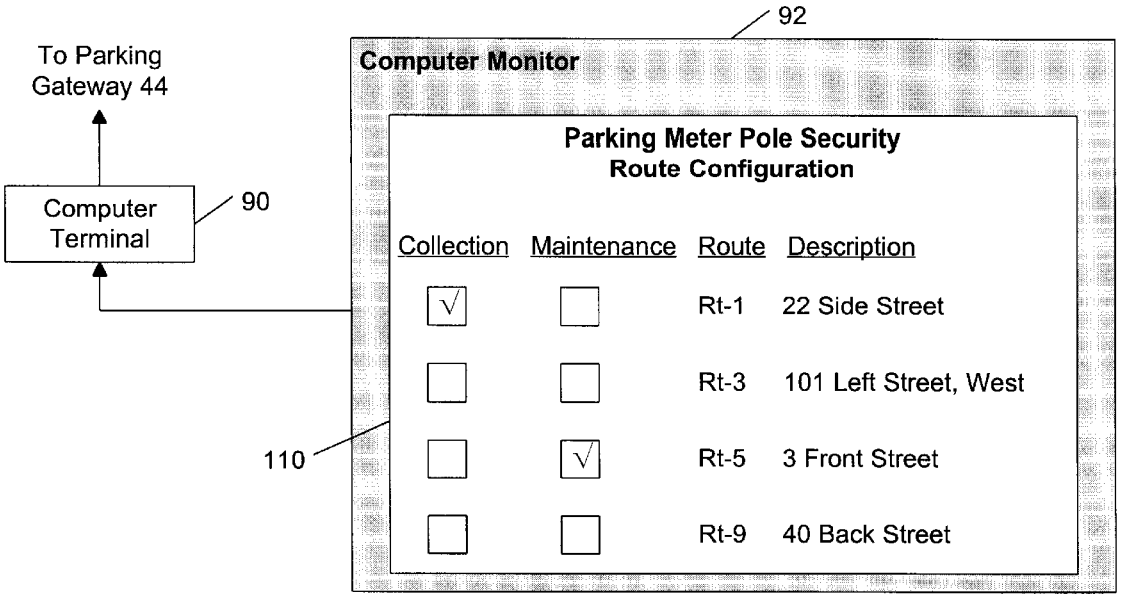
FIG. 6B is a diagrammatic view of a computer terminal and a computer monitor for displaying a form prompting a user to enter meta information for qualifying the meter status information received from the parking meter systems of FIG. 3.

Referring to FIG. 6B, parking gateway 44 may display on computer monitor 92 a form 110 prompting a user (e.g., a police officer or dispatcher) to enter information relating to planned collection or maintenance schedules. In the example shown, the user may indicate in real time whether a particular route currently is scheduled for collection or maintenance or both simply by entering a check mark in the collection and maintenance boxes for a particular route. An authorized entity responsible for meter collection and maintenance also may connect to parking gateway 44 and send information relating to collection and maintenance activities to parking gateway 44 over public network 28.

Other embodiments are within the scope of the claims.

For example, other parking meter system configurations may be used. Certain available parking meter systems are capable of monitoring the total amount of funds that have been deposited into the vault since the last collection. This information may be transmitted to parking gateway 44 for processing. Parking gateway 44 may be configured to analyze the total fund information received from the parking meters systems corresponding to each route to determine when the meters along each route such be collected. This qualified information may be transmitted to the entity responsible for collections to enable this entity to optimize the allocation of resources deployed to collect funds from the meter systems. For example, when the average total meter capacity of a particular route is greater than 50% full and more than 5% of the meter systems along this route are greater than 90% fill, parking gateway 44 may send a signal to the collection entity indicating that this route should be scheduled for collection in the near future.

Still other embodiments are within the scope of the claims.

What is claimed is:

1. A processing system, comprising:

a processor configured to qualify environmental status information extracted from signals received form a plurality of sensors located at a first remote location, wherein each of the sensor signals is indicative of the condition of a respective environment being monitored by a corresponding one of the sensors, and wherein the environmental status information is extracted at a second remote location and is qualified at least in part on meta information to distinguish authorized from unauthorized interactions with the monitored environment.

2. The system of claim 1, further comprising at least one collector configured to extract environmental status information from signals received from one or more sensors.

3. The system of claim 1, further comprising a plurality of remote sensors each configured to monitor one or more parameters representative of the condition of a respective environment and to transmit signals representative of the one or more monitored parameters.

4. The system of claim 3, wherein each of the sensors has a wireless transmitter for transmitting signals representative of the one or more monitored parameters.

5. The system of claim 1, wherein the processor is configured to receive from a user meta information for qualifying the environmental status information.

6. The system of claim 5, wherein the processor is configured to receive meta information in the form of a schedule of planned visits to each of the monitored environments.

7. The system of claim 5, wherein the processor is configured to receive in real time meta information from a user in the form of a schedule of one or more planned visits to one or more of the monitored environments.

8. The system of claim 5, wherein the processor is configured to qualify sensor signals representative of an alarm condition based upon the received meta information.

9. The system of claim 5, wherein the processor is configured to qualify sensor signals representative of an alert condition based upon the received meta information.

10. The system of claim 1, wherein the processor is configured to present the qualified environmental status information on a display.

11. The system of claim 10, wherein the processor is configured to present on the display a form prompting a user to enter meta information for qualifying the environmental status information.

12. The system of claim 1, wherein each of the sensors is configured to monitor the physical condition of a respective parking meter.

13. The system of claim 12, wherein each of the sensors is configured to monitor opening and closing of the parking meter.

14. The system of claim 1, wherein each of the sensors is configured to monitor the physical condition of a respective vending machine.

15. The system of claim 1, wherein each of the sensors is configured to monitor the physical condition of a respective piece of office equipment.

16. The system of claim 1, wherein each of the sensors is configured to monitor the physical condition of a respective residential home.

17. The system of claim 1, wherein the environmental status information corresponds at least in part to the amount of funds contained in a plurality of remote, physically distributed parking meter systems, and the processor is configured to qualify the environmental status information to provide an indication when the parking meter systems should be scheduled for collection.

18. A processing system, comprising:

a plurality of sensors located at a first remote location and configured to monitor one or more parameters representative of the condition of a respective environment and to transmit signals representative of the one or more monitored parameters;

at least one collector located at a second remote location and configured to extract environmental status information from signals received from one or more of the plurality of sensors; and a processor configured to qualify the extracted environmental status information based at least in part upon meta information to distinguish authorized from unauthorized interactions with the monitored environment.

19. The system of claim 18, wherein each of the sensors is configured to monitor the physical condition of a respective parking meter.

20. A processing system, comprising:

a processor configured to generate a report to distinguish authorized from unauthorized interactions with a plurality of physically distributed environments located at a first remote location, wherein the report is based at least in part upon correlation of environmental status information extracted at a second remote location from a plurality of sensor signals received from the first remote location and indicative of the condition of the plurality of physically distributed environments with information relating to the activities of one or more entities authorized to interact with the physically distributed environments.

21. A processing method, comprising:

qualifying environmental status information extracted from signals received from a plurality of sensors located at a first remote location, wherein each of the sensor signals is indicative of the condition of a respective environment being monitored by a corresponding one of the sensors, and wherein the environmental status information is extracted at a second remote location and is qualified based at least in part upon meta information to distinguish authorized from unauthorized interactions with the monitored environment.

22. The method of claim 21, further comprising extracting environmental status information from signals received from one or more sensors.

23. The method of claim 21, further comprising monitoring one or more parameters representative of the condition of a respective environment and wirelessly transmitting signals representative of the one or more monitored parameters.

24. The method of claim 21, further comprising receiving from a user meta information for qualifying the environmental status information.

25. The method of claim 24, wherein meta information is received in the form of a schedule of planned visits to each of the monitored environments.

26. The method of claim 24, wherein meta information is received in real time from a user in the form of a schedule of one or more planned visits to one or more of the monitored environments.

27. The method of claim 24, wherein sensor signals representative of an alarm condition are qualified based upon the received meta information.

28. The method of claim 24, wherein sensor signals representative of an alert condition are qualified based upon the received meta information.

29. The method of claim 21, further comprising presenting the qualified environmental status information on a display.

30. The method of claim 29, further comprising displaying a form prompting a user to enter meta information for qualifying the environmental status information.

31. A processing method, comprising:

monitoring one or more parameters indicative of the condition of a plurality of environments, with a respective plurality of sensors located at a first remote location;

wirelessly transmitting signals representative of the one or more monitored parameters;

receiving the transmitted signals at a second remote location;

extracting environmental status information from the received signals at the second remote location; and qualifying the extracted environmental status information based at least in part upon meta information received from a user to distinguish authorized from unauthorized interactions with the plurality of environments.

32. A processing method, comprising:

receiving environmental status information at a second remote location from a plurality of sensor signals transmitted from a plurality of sensors located at a first remote location and indicative of the condition of a plurality of physically distributed environments;

receiving meta information relating to the activities of one or more entities authorized to interact with the plurality of physically distributed environments;

correlating the environmental status information with the meta information to distinguish authorized from unauthorized interactions with the plurality of physically distributed environments; and generating a report of the status of the plurality of physically of physically distributed environments based at least in part upon the results of the correlation.

33. The processing method of claim 32, further comprising presenting the report to a supervising entity.

34. A parking meter security system, comprising:

a plurality of parking meters distributed along one or more routes;

a plurality of remote sensors respectively attached to the plurality of parking meters and configured to monitor one or more parameters representative of the condition of the parking meters and to transmit signals representative of the one or more monitored parameters;

one or more collectors distributed along the one or more parking meter routes, wherein each collector is configured to extract environmental status information from the signals received from the remote sensors attached to the parking meters along the one or more routes; and a gateway device comprising a processor configured to qualify the extracted environmental status information based at least in part upon meta information to distinguish authorized from unauthorized interactions with the parking meters distributed along the one or more routes.

35. A processing method, comprising:

monitoring one or more parameters indicative of the condition of a plurality of parking meters distributed along one or more routes with a plurality of sensors respectively attached to the meters;

wirelessly transmitting signals representative of the one or more monitored parameters to one or more collectors respectively distributed along the one or more parking meter routes;

receiving the transmitted signals;

extracting environmental status information from the received signals; and qualifying the extracted environmental status information based at least in part upon meta information to distinguish authorized from unauthorized interactions with the parking meters distributed along the one or more routes.

* * * * *